US006152571A

United States Patent [19]

Ruiz

[11] Patent Number: 6,152,571

[45] Date of Patent: Nov. 28, 2000

[54] ADJUSTABLE LAMP

[75] Inventor: Robert Garrigós Ruiz, Girona, Spain

[73] Assignee: Sacopa, S.A., Girona, Spain

[21] Appl. No.: 09/190,725

[22] Filed: Nov. 12, 1998

[30] Foreign Application Priority Data

Nov. 12, 1997 [ES] Spain ..... 9702358

[51] Int. Cl.[7] ..... F21V 25/00

[52] U.S. Cl. ..... 362/101; 362/365; 362/267; 362/289; 362/287; 362/288; 362/418; 362/419; 362/148; 362/457; 362/265; 362/390; 362/369

[58] Field of Search ..... 362/101, 365, 362/267, 289, 287, 288, 418, 419, 285, 147, 390, 369, 306, 148, 364, 457, 265

[56] References Cited

U.S. PATENT DOCUMENTS 1,747,859 2/1930 Coulter ..... 362/287
5,508,897 4/1996 Van Order ..... 362/80
5,607,224 3/1997 Tobias et al. ..... 362/101
5,609,408 3/1997 Targetti ..... 362/66

*Primary Examiner*—Sandra O'Shea
*Assistant Examiner*—Anabel M. Ton
*Attorney, Agent, or Firm*—Maria Parrish Tungol; John A. Parrish

[57] ABSTRACT

The invention relates to an adjustable lamp which can be fitted into a wall such as the, wall of a swimming pool or other water tank the bulb of the lamp can be positioned so that it is parallel to the horizontal, or have with a downward slant, typically between about 3° to about 8°. The lamp can include an elbow duct for receiving electric cables to the lamp. The lamp can be directed in at least eight different angles relative to the point on the wall where these cables reach the lamp by positioning its lighting axis so that it is parallel to the horizontal, or with a downward slant, while the elbow duct for electric cables to the lamp, can be directed in eight different angles, towards the point on the wall where these cables reach the lamp.

22 Claims, 4 Drawing Sheets

ADJUSTABLE LAMP

FIELD OF THE INVENTION

The invention relates to adjustable lamps. In particular, the invention relates to an underwater lamp, which can be fitted into the wall of a swimming pool or other water tank and is capable of having its lighting axis positioned so that it is parallel to the horizontal, or with a downward slant of between 3° and 8°, while the elbow duct for electric cables to the lamp, can be directed in eight different angles, towards the point on the wall where these cables reach the lamp.

BACKGROUND OF THE INVENTION

There are various advantages which make it desirable or necessary to light the inside of a swimming pool or other large water tanks. To do this, underwater lamps are installed at different points on the walls of the tank.

The lamp consists of a bulb with or without convex crowns, powered by electricity and installed inside a surrounding shell. This shell is placed inside a recess in the wall and its outside side is covered by a screen of glass or other sufficiently transparent material. When the lamp is on, it projects a beam of light rays inside the water, the symmetry axis of which is provided by the characteristics of the bulb and the reflector inside the shell. The nature of water means that in very short stretches of rays, the beam becomes very diffused, but always maintains the symmetry axis.

At present, these lamps are installed so that the axis of the beam is parallel to the horizontal, or slanted downwards at an angle of between 4° and 8°.

This downward slant is desirable in many private swimming pools to avoid waves on the water surface from refracting light outside the pool, which would light the surrounding area, causing an undesired effect.

Also, once certain prefabricated pools are installed, their section profile alters from rectangular to slightly trapezoidal with the short side of the trapezoid at the base. The reason for this is the pressure of earth, which is greater at the deeper parts of the walls, which means that these move slightly towards the inside of the pool. On these walls, lamps with a downward axis have to be installed, as a horizontal axis would light upwards.

At the present time lamps installed with a horizontal axis cannot be installed with a sloping axis. Stores have to stock both types. The fitter has to choose one type or another when carrying out the installation. If the direction of the axis has to be changed after installation, the whole lamp has to be changed.

Before making the recess in the wall, it must be known from which direction the cables will reach the lamp, and depending on this direction, the elbow inlet duct of cables to the recess is placed accordingly. Using current techniques, the elbow duct is fixed to the lamp in its final position at the set direction. In the event that it is later seen that this direction is incorrect because the labourer made the recess for the lamp, or the cable channel at a slightly different position, which in reality occurs more often than installers would like, the lamp has to be discarded and a new one installed.

SUMMARY OF THE INVENTION

The invention relates to an adjustable lamp which can be fitted into a wall such as the wall of a swimming pool or other water tank. The bulb of the lamp can be positioned so that it is parallel to the horizontal, or have with a downward slant, typically between about 3° to about 8°. The lamp can include an elbow duct for receiving electric cables to the lamp. The lamp can be directed in at least eight different angles relative to the point on the wall where these cables reach the lamp by positioning its lighting axis so that it is parallel to the horizontal, or with a downward slant of between 3° and 8°, while the elbow duct for electric cables to the lamp, can be directed in eight different angles, towards the point on the wall where these cables reach the lamp.

DETAILED DESCRIPTION OF THE INVENTION

An adjustable lamp has been created to solve the above described inconveniences of stock or installation, to avoid a situation in which an error or miscalculation of the type stated above wherein another lamp has to be installed, and to provide the user with the possibility of changing the direction of the light beam of the installed lamp without having to replace it or carry out works.

The invention includes a lamp having two rings for securing the lamp to a wall, for example, a wall of a swimming pool wherein the direction of the light beam of the installed lamp can be changed in a convenient manner. In another aspect of the invention, an elbow duct with an octagonal periphery projection is provided to avoid the inconveniences and situations described previously when it is necessary to change the orientation of the elbow duct.

The profile view of the fastening ring has a very long rectangular section. The ring is cut according to a plane which is slanted at between 1.5° and 4° with respect to the middle plane of this rectangle, so that two trapezoidal profile sections are produced in which the parallel sides of the trapezoid correspond to what were the short sides of the rectangle.

What was previously a fastening ring is therefore transformed into two divisional inner and outer rings. These two rings can be fitted inside one another in two positions: by placing the short parallel side of one opposite the long side of the other, in which case a rectangular section ring would be produced identical to the one if it had not been divided into two and therefore the symmetry axis is horizontal and does not slant downwards, or by facing the two long sides and the two short sides, in which case a trapezoidal section ring would be produced, and on fixing to the wall as one of the sides remains vertical, the side facing the water accumulates the sloping degrees of each one of the two sloping planes, giving a total downward slant of between 3° and 8°, and the symmetry axis of the bulb also remains at this downward slant.

The inner ring is fastened to the bulb and this unit is fastened to the outer ring, cancelling or adding the division angles, and fastened to the wall in the usual manner. These rings fitted in one of the two ways, can be released to adjust them in another way, and then fastened again to the wall, thereby changing the previous position of the symmetry axis.

In the adustable elbow duct with the octagonal projection, the opposite straight sides in the periphery of the octagonal projection fit into two projecting flaps from the shell of the lamp. The flaps face each other at an equal distance from the centre of the inlet of electric cables to the shell, and the distance is adapted to the distance between the two opposite sides of the octagon in the periphery of the duct projection.

The elbow duct has a threaded section on the part which will be inside the shell. Once the direction has been determined, a female thread preceded by a rubber O-ring which will seal the gasket between the shell and the elbow duct, is threaded to the male thread.

Figure 2:
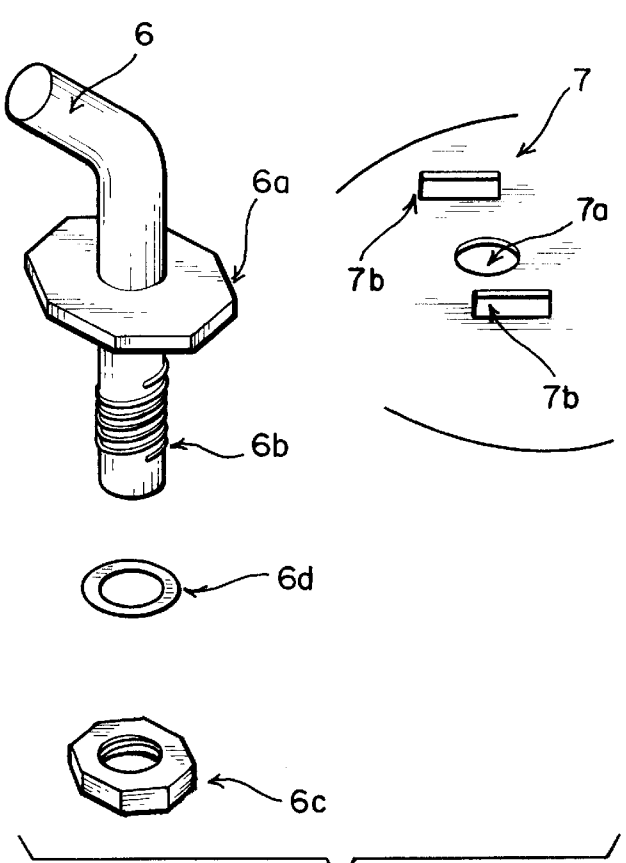
Figure 1:
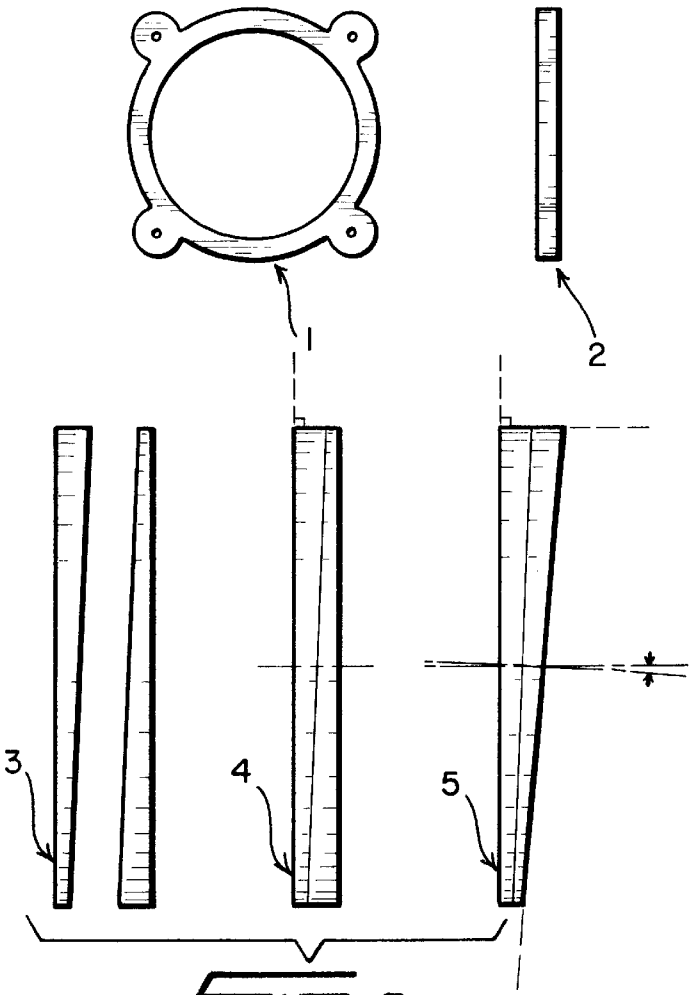
FIG. 1
Figure 3:
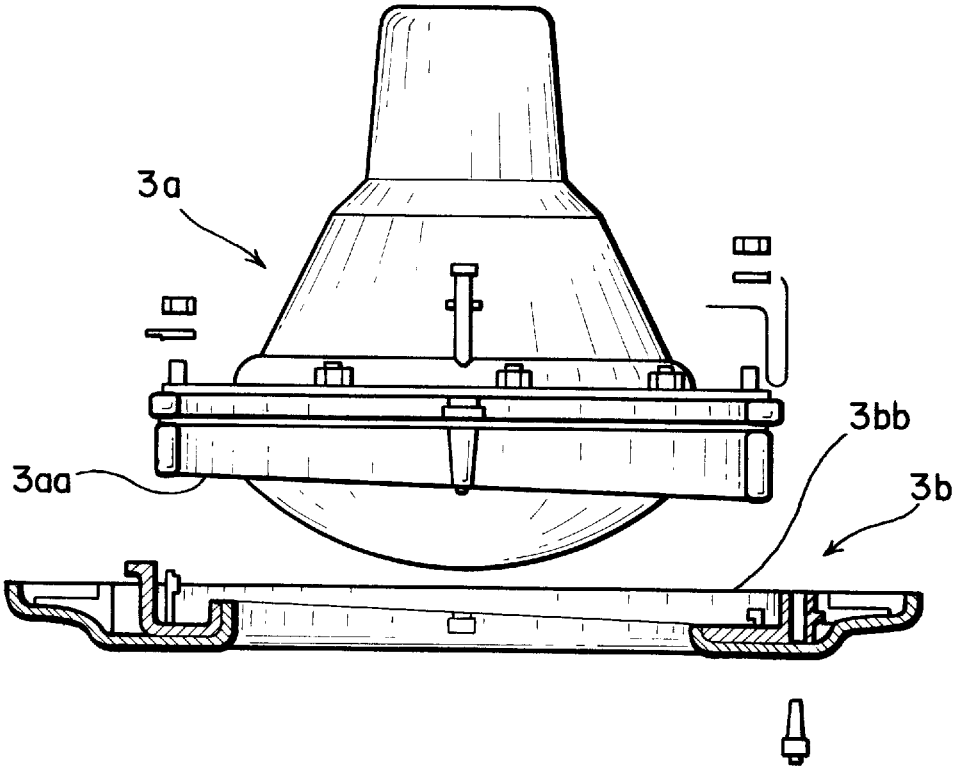
Figure 3:
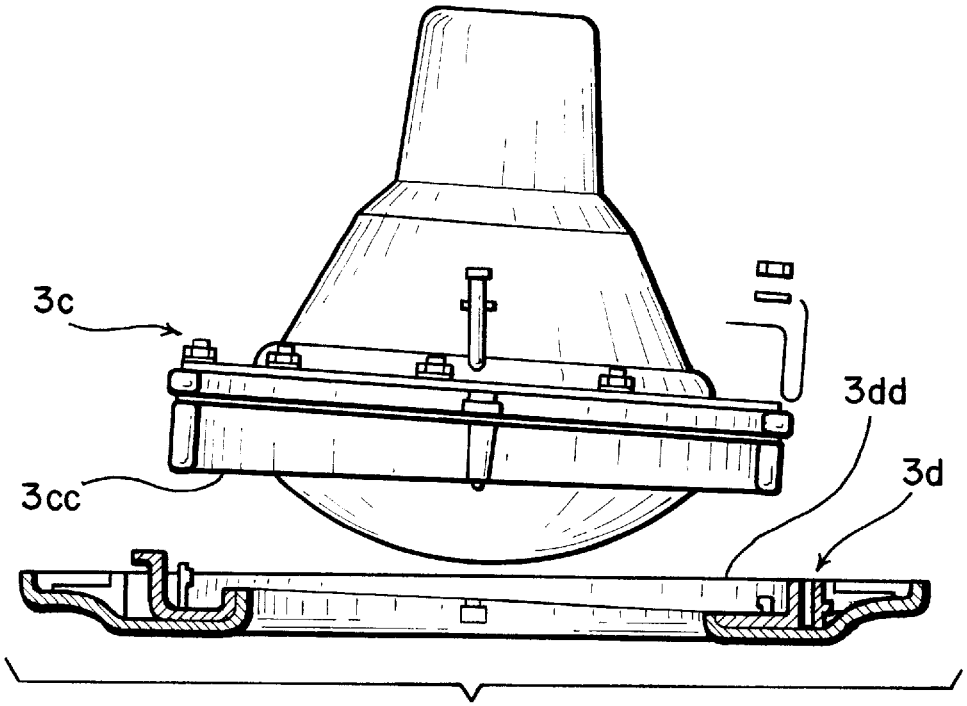
Figure 4:
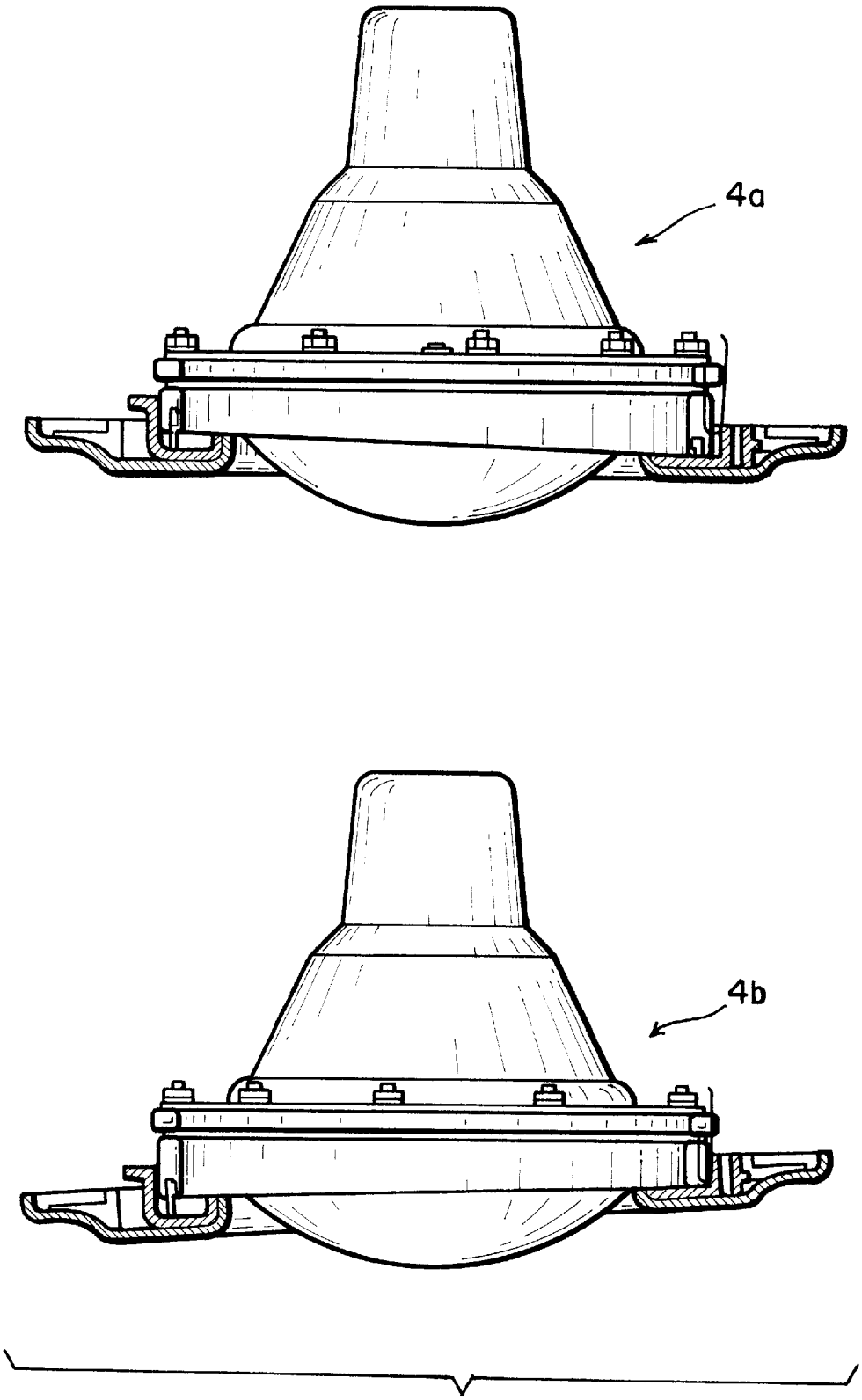
Figure 5:
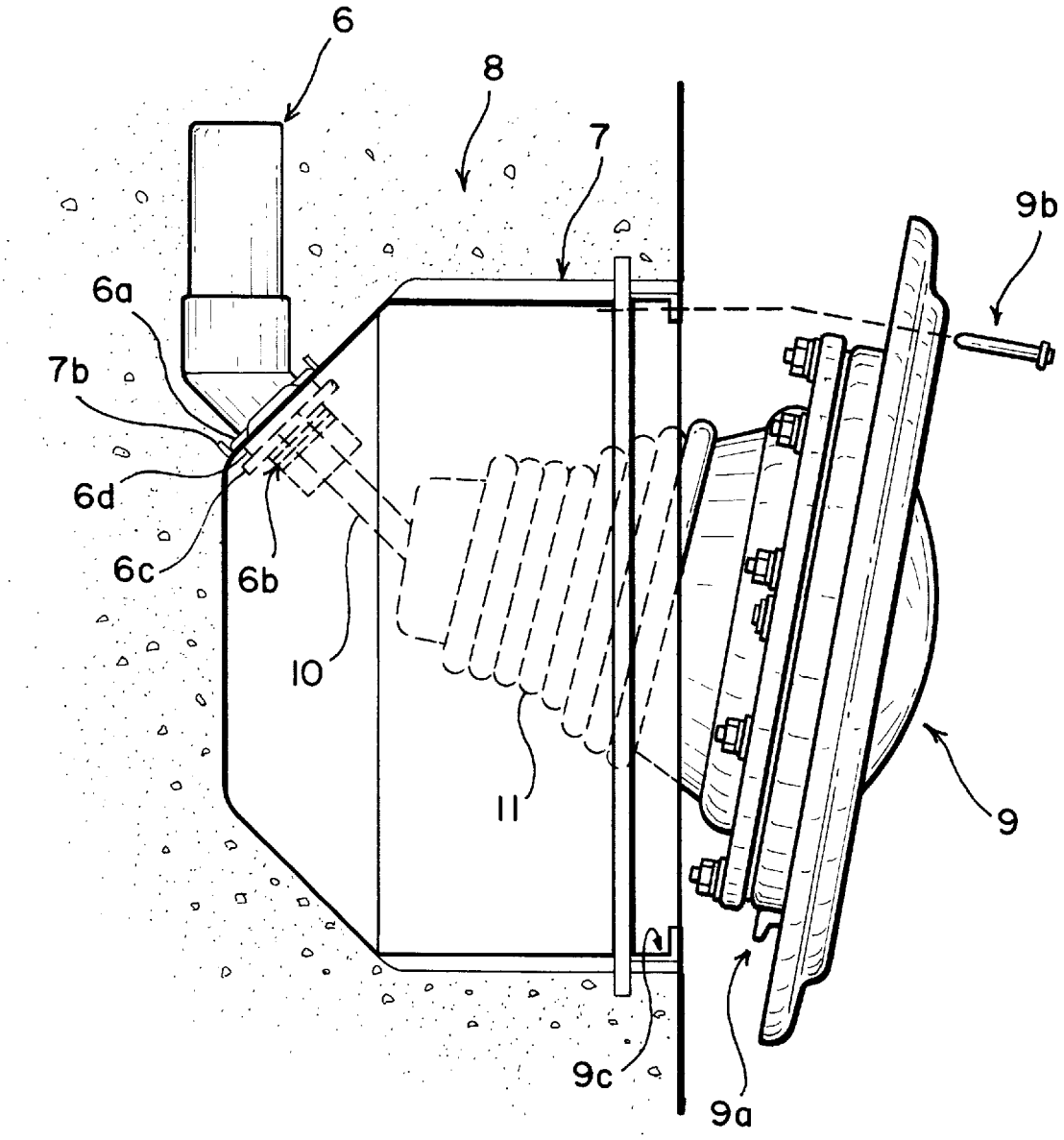

1. Fastening ring of the shell to the wall.

2. Profile of ring 1.

3. Profile of the ring once it is divided into two rings. (The division angle has been exaggerated for viewing purposes).

4. The two divisional rings are joined so that the division angles are cancelled and the perpendicular to a long side is also perpendicular to the other long side.

5. The two divisional rings are joined so that the division angles are added and the perpendicular to one long side forms an angle of between 3° and 8° with respect to the perpendicular of the other long side.

FIG. 2

6. Elbow duct (6) with octagonal periphery projection (6*a*) and threaded section (6*b*) at one end.

6*c*. Female thread.

6*d*. Elastic O-ring.

7. Part of the lamp shell (7) where the elbow tube and electric cables inlet (7*a*) is located and the two fastening flaps (7*b*) of the octagonal projection.

FIG. 3

3*a*. Bulb with the inner divisional ring (3*aa*) in place to be installed with a horizontal light beam axis.

3*b*. Outer divisional ring (3*bb*) in place to be attached to part (3*a*).

3*c*. Bulb with the inner divisional ring (3*cc*) in place to be installed with a slanting light beam axis.

3*d*. Outer divisional ring (3*dd*) in place to be attached to part (3*c*).

FIG. 4

4*a*. Result of mounting 3*a* on 3*b* and the unit on the wall for horizontal light beam.

4*b*. Result of mounting 3*c* on 3*d* and the unit on the wall for slanting light beam.

FIG. 5

6. Elbow duct

6*b*. Threaded section of elbow duct 6

6*c*. Female thread

6*d*. Elastic O-ring

7. Lamp shell in cross section inserted in swimming pool wall

7*b*. Fastening flaps of octagonal member 6*a*

8. A solid wall such as the concrete wall of a swimming pool.

9. Bulb with inner and outer rings mounted and assembled in either position 4*a* or 4*b*, prepared to be affixed into the shell by fitting the hook 9*a* into space 9*c* and then screwing screw 9*b* into the shell where there is a prepared hole.

10. Electrical cable.

11. Holder to hold the lamp

Once the shell has been placed in the recess, the glass cover is placed and it is fixed using divisional rings, with a division angle of about 2°. The divisional rings are connected in the first installation cancelling their division angles and the beam is of a horizontal axis (4*a*). After a time, the divisional rings can be dismounted and then mounted adding the division angles and thereby providing a downward slant of the beam axis of about 4° (4*b*).

The adjustable elbow duct (6) of the cable inlet can be connected to the lamp shell (7) by the thread section (6*b*) and the female thread (6*c*) supplied with an elastic O-ring (6*d*), leaving the outer hole of the duct in the position of the foreseen direction between the recess and the channel by means of a connection between the octagonal periphery (6*a*) and flaps (7*b*). It is inserted in the recess by placing tile cables (10) inside the shell (7).

The flaps are parallelepipedic protuberances separated by the distance that makes the octagonal (6*a*). The threaded section is introduced through opening (7*a*) so that the two opposite sides of the octagon (6*a*) remain faced to each other and fixed by the flaps while the toric rubber part (6*d*) and the female part (6*c*) are screwed to make a hermetic closing from the inner part of 7 to the outer part of 7.

If, in the event of a miscalculation or installation error of the elbow duct (6), the direction of the outer hole of the elbow duct (6) has to be modified, the nut (6*c*) is unscrewed, the projection octagon (6*a*) is turned to the required position and the thread (6*c*) is screwed again to the gasket (6*d*).

What is claimed is:

1. An adjustable lamp for installation within a wall, said lamp having a bulb, a shell over the bulb, an inlet in the shell cooperatively engaging an adjustable elbow for providing electrical access to the bulb wherein the lamp also includes a system of two rings wherein a first of said rings engages the bulb while a second of said rings cooperating with the first of said rings enables the bulb to be adjusted to point in a desired direction.

2. Lamp according to claim 1 wherein the trapezoidal cross section includes a slant angle between the elongated sides, the slant angle having a value of between about 1.5° and about 4°.

3. Lamp according to claim 1 wherein the system of two rings includes an outer divisional ring and an inner divisional ring.

4. Lamp according to claim 3 wherein the system of two rings comprises an outer divisional ring adapted to be affixed to the wall and an inner divisional ring affixed to the bulb.

5. Lamp according to claim 3 wherein the outer divisional ring is adapted to be fastened to the wall by a fastening hook.

6. An adjustable lamp for installation within a wall, said lamp having a bulb, a shell over the bulb, and an inlet in the shell for providing electrical access to the bulb wherein the lamp includes an adjustable elbow duct for providing electrical access to the lamp and the shell has an inlet hole flanked by two facing flaps said elbow duct adapted to engage said hole and said flaps.

7. Lamp according to claim 6 wherein the elbow duct has an octagonal periphery projection and wherein the elbow duct is positioned in the shell.

8. Lamp according to claim 7 wherein the shell includes an inlet hole for receiving the elbow duct, the inlet hole flanked by two facing flaps for securing the octagonal periphery to the shell.

9. The lamp according to claim 8 wherein tile elbow duct is fastened to the shell by a nut and an O-ring.

10. An adjustable lamp for installation within a wall, said lamp having a bulb, a shell over the bulb, an inlet in the shell cooperatively engaging an adjustable elbow duct for providing electrical access to the lamp wherein the shell has an inlet hole flanked by two facing flaps, said elbow duct is adapted to engage said hole and said flaps and wherein the lamp also includes a system of two rings wherein a first of said ring is cooperatively connected to the bulb while a second of said rings cooperating with the first of said rings enables the bulb to be adjusted to point in a desired direction.

11. Lamp according to claim 10 wherein each of the two rings has a trapezoidal cross section having elongated sides.

12. Lamp according to claim 11 wherein the trapezoidal cross section includes a slant angle between the elongated sides, the slant angle having a value of between about 1.5° and about 4°.

13. Lamp according to claim 10 wherein the system of two rings includes an outer divisional ring and an inner divisional ring.

14. Lamp according to claim 13 wherein the system of two rings comprises an outer divisional ring adapted to be affixed to the wall and an inner divisional ring affixed to the bulb.

15. Lamp according to claim 13 wherein the outer divisional ring is adapted to be fastened to the wall by a fastening hook.

16. Lamp according to claim 10 wherein the elbow duct has an octagonal periphery projection and wherein the elbow duct is positioned in the shell.

17. Lamp according to claim 16 wherein the shell includes an inlet hole for receiving the elbow duct, the inlet hole flanked by two facing flaps for securing the octagonal periphery to the shell.

18. Lamp according to claim 17 wherein the elbow duct is fastened to the shell by a nut and an O-ring.

19. An adjustable lamp for installation within a wall, said lamp having a bulb, a shell over the bulb, an inlet in the shell for providing electrical access to the bulb wherein the bulb is cooperatively connected to a system of two rings wherein the system of two rings comprises an outer divisional ring cooperatively engaging an inner divisional ring wherein each of said rings has a trapezoidal cross section with elongated sides whereby the orientation of the symmetry axis of the bulb can be varied by changing the orientation of the elongated sides of the outer divisional ring relative to the elongated sides of the inner divisional ring.

20. Lamp according to claim 19 wherein the trapezoidal cross section includes a slant angle between the elongated sides, the slant angle laving a value of between about 1.5° and about 4°.

21. Lamp according to claim 19 wherein the system of two rings comprises an outer divisional ring adapted to be affixed to the wall and an inner divisional ring affixed to the bulb.

22. Lamp according to claim 19 wherein the outer divisional ring is adapted to be fastened to the wall by a fastening hook.

* * * * *